United States Patent [19]

May

[11] Patent Number: 4,785,276

[45] Date of Patent: Nov. 15, 1988

[54] VOLTAGE MULTIPLIER VARISTOR

[75] Inventor: John E. May, Skaneteles, N.Y.

[73] Assignee: General Electric Company, Fairfield, Conn.

[21] Appl. No.: 911,931

[22] Filed: Sep. 26, 1986

[51] Int. Cl.[4] ..... H01C 7/10
[52] U.S. Cl. ..... 338/21; 338/25
[58] Field of Search ..... 338/21, 325, 327, 328, 338/309

[56] References Cited

U.S. PATENT DOCUMENTS 4,212,045 7/1980 Martzloff ..... 338/21 X
4,431,983 2/1984 Rodriquez ..... 338/22 R

FOREIGN PATENT DOCUMENTS 1011859 6/1977 Canada ..... 338/21
7507645 7/1974 Netherlands ..... 338/21

*Primary Examiner*—C. L. Albritton
*Attorney, Agent, or Firm*—Stanley C. Corwin; Birgit E. Morris; Kenneth R. Glick

[57] ABSTRACT

A varistor having a plurality of spaced electrodes positioned on common surface thereof and a conductive layer positioned on the opposed major surface thereof.

8 Claims, 2 Drawing Sheets

VOLTAGE MULTIPLIER VARISTOR

BACKGROUND OF THE INVENTION

I. Field of the Invention

The present invention relates in general to varistors, and more particularly to such varistors having voltage rating characteristics which may be varied without varying the thickness of the varistor body.

II. Description of Related Art

Varistors, and especially metal oxide varistors, have gained widespread acceptance as devices for providing a nonlinear resistance function. The electrical characteristics of such voltage-dependent resistors are expressed in part by the relation:

$$I=(V/C)^n$$

where V is the voltage across the varistor, I is the current flowing through the varistor, C is a constant corresponding to the voltage at a given current, and the exponent n has a numerical value greater than 1. The value of n is calculated according to the following relation:

$$n=\frac{\log_{10}(I_2/I_1)}{\log_{10}(V_2/V_1)}$$

where $V_1$ and $V_2$ are the voltages at currents $I_1$ and $I_2$, respectively. The desired value for C depends upon the type of application in which the varistor is to be used. It is ordinarily desirable that the value of n be as large as possible, since this exponent determines the degree to which the varistor departs from Ohmic characteristics.

Although substantial effort on the part of many investigators has led to increasing understanding of the characteristics and methods of operation of metal oxide varistors, the device is nevertheless not completely understood. For this reason, many significant improvements in varistor operation are made more or less heuristically, and the reasons for the improvement or mechanism or the accomplishment thereof are not always known with complete certainty.

It is known, however, that the electrical properties of a varistor are determined primarily by the physical dimensions of the varistor body. The energy rating of a varistor is determined by the volume of the varistor body, the voltage rating of a varistor is determined by the thickness or current path length through the varistor body, and the current capability of the varistor is determined by the area of the varistor body measured normal to the direction of current flow.

The varistor body itself is composed essentially of a polycrystalline material. Each crystal grain boundary within the polycrystalline varistor body acts in a manner essentially similar to that of a diode. The voltage rating of such a varistor may therefore be controlled by changing the number of grain boundaries between the electrodes positioned on the surface of the varistor body. The voltage rating of such a varistor is typically increased merely by making the varistor body thicker, since this will increase the number of crystals, and consequently the number of crystal grain boundaries, between the electrodes on the varistor body surface.

This method of increasing the voltage rating of the varistor does, however, have several disadvantages. Increasing the thickness of the varistor body solely to increase the voltage rating of the varistor device is not an efficient utilization of varistor body material. In addition, increasing the thickness of the varistor body tends to increase the series resistance between electrodes, which is an undesirable characteristic in certain applications. Moreover, in those applications in which the varistor is of the surface-mounted variety (i.e., the varistor input and output terminals are mounted on the same surface of the device), it is generally desirable that the varistor device lie flat. That is, surface-mounted varistors are preferably designed to be deposited in position on a printed circuit board or the like so that, once deposited, they will remain in position and will not roll over. If the vertical thickness of the varistor device is too large, the varistor will not be able to maintain a stable position on the circuit board and will instead tend to fall over.

Varistors in which both the input and output terminals are positioned on the same major surface of the varistor body are generally referred to as "surface mount" varistors. The voltage rating of such surface mount varistors is primarily a surface property of the varistor device (i.e., it is dependent primarily upon the current flowing along the surface of the device), rather than a bulk property (i.e., dependent primarily upon the current flowing through the thickness of the varistor body). The voltage rating of such surface mount varistors may be increased without increasing the thickness of the varistor body. This may typically be accomplished merely by increasing the distance separating the electrodes on the same major surface of the varistor.

However, there are certain disadvantages associated with surface mount varistors which limits the use of such varistors in certain applications. One such disadvantage is the fact that surface mount varistors, in general, cannot absorb relatively large amounts of energy. Surface mount varistors also tend to be prone to a number of unwanted surface effects. For example, water, humidity, or fingerprints applied to the surface of the varistor are known to have adverse effects upon the operation of the device. These adverse effects are, in general, not experienced by bulk varistor devices.

It is an object, therefore, of the present invention to provide a varistor having a voltage rating which may be varied without varying the thickness of the varistor body.

It is a further object of the present invention to provide a surface mount varistor having a voltage rating which is not primarily a surface property of the device.

It is another object of the present invention to provide a varistor which more efficiently utilizes varistor body material.

SUMMARY OF THE INVENTION

In accordance with the present invention, these and other objectives are achieved by providing a varistor body having a first major surface and an opposed second major surface. One or more conductive regions are disposed on each of the opposed major surfaces. These conductive regions are positioned such that the distance separating any conductive region and the nearest adjacent conductive region on the same surface of the varistor body is greater than the distance separating that conductive region and the nearest conductive region on the opposed surface of the varistor body. Current flowing through the varistor device will therefore tend to flow through the thickness of the varistor body between conductive regions on opposing major surfaces, rather than along the surface of the varistor body to the nearest adjacent conductive region on the same surface of the varistor body. With each pass of the current through the thickness of the varistor body, the current will undergo a voltage drop. The total voltage rating of the varistor device will be substantially equal to the sum of the individual voltage drops experienced by the current flowing through the thickness of the device. The number of voltage drops, and hence the total voltage rating of the device, may be increased by adding additional conductive layers to the opposed surfaces of the device.

DESCRIPTION OF THE DRAWINGS

A detailed description of the invention will be made with reference to the accompanying drawings, wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is defined by the appended claims.

Figure 1:
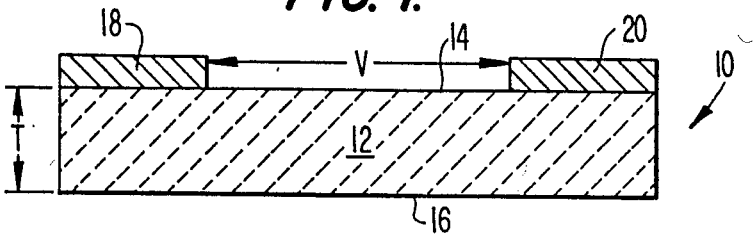
FIG. 1 is a side-sectional view of a surface-mount varistor.

Referring to FIG. 1, there is shown a varistor 10 which includes a body portion 12 having a first major surface 14 and a an opposed second major surface 16. Body portion 12 is preferably a sintered body composed essentially of a metal oxide such as zinc oxide, and a plurality of preselected additives. Methods for manufacturing varistor body 12 are well-known to those skilled in the art and therefore will not be extensively described herein. Generally, by way of example and not of limitation, the formation of varistor body 12 includes the steps of mixing the major constituents, spray drying and pressing into a compact "green" varistor pellet. The pellet is then sintered at a high temperature to provide a body having the desired varistor characteristics.

Varistor 10 further includes first and second electrodes 18 and 20, which are applied to the first major surface 14 of the varistor body 12. Conveniently, and again by way of example rather than of limitation, electrodes 18 and 20 may be silver paint electrodes which are applied to the first major surface 14 of varistor body 12 by silkscreening or the like, and fired at a relatively high temperature such as 800° C. to provide electrical contact to the varistor body 12. Electrically conductive leads (not shown) may be attached to the electrodes 18 and 20, typically by soldering.

A varistor device 10 configured as shown in FIG. 1 will exhibit a voltage rating characteristic which is linearly proportional to the distance between the electrodes 18 and 20. The measurements which follow were determined experimentally utilizing a varistor 10 having a thickness T of 1.5 mm and a diameter of 20 mm, with electrodes 18 and 20 which were approximately 1.75 mm wide and 6.0 mm long. The voltage was measured between electrodes 18 and 20 at a standard current of 1 milliampere (mA). The voltage rating was approximately 55 volts when electrodes 18 and 20 were spaced apart by a distance of 1.5 mm. For electrodes 18 and 20 which were separated by a distance of approximately 3.0 mm, the voltage rating was approximately 113 volts. A spacing of approximately 4.5 mm between electrodes 18 and 20 resulted in a voltage rating of approximately 167 volts. These measured voltage ratings are set out below in the first line of Table A.

Figure 2:
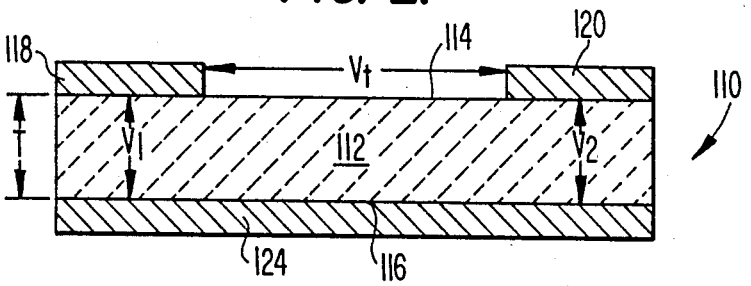
FIG. 2 is a side-sectional view of a surface-mount varistor in accordance with one embodiment of the invention in which a layer of conductive material is provided on a major surface of a varistor body opposite the varistor electrodes.

FIG. 2 illustrates a varistor 110 in accordance with a preferred embodiment of the present invention. In this and the following figures, like elements are designated by like reference numerals. A varistor body 112 has first and second electrodes 118 and 120 attached to the first major surface 114 thereof. The formation of varistor body 112, as well as the attachment of the electrodes 118 and 120 thereto, may be accomplished as hereinabove described in conjunction with FIG. 1.

In accordance with the present invention, varistor 110 includes a layer or region of conductive material 124 which is applied to the second major surface 116 of the varistor body 112. This conductive layer 124 may be made of material similar to that of the first and second electrodes 118 and 120, and may be applied to the second major surface 116 of the varistor body 112 in a manner similar to that of the electrodes 118 and 120. In contrast to the electrodes 118 and 120, however, no electrically conductive leads are intended to be attached to the conductive layer 124, and thus the conductive layer 124 may be referred to as a "non-biased" conductive region.

When the conductive layer 124 is present, the voltage rating measured between electrodes 118 and 120 is found to be less than before for electrode separations greater than the thickness T of the varistor body 112. The measurements which follow were determined experimentally utilizing a varistor 110 which was dimensionally identical to the previously described varistor 10. However, varistor 110 included a conductive layer 124 along its second major surface 116 in accordance with the present invention. For electrodes 118 and 120 which were separated by a distance of 1.5 mm the voltage rating was found to be 56 volts, approximately the same voltage as measured in the varistor 10 of FIG. 1 for an identical electrode spacing. However, when the voltage rating of the varistor 110 was measured at an electrode spacing of 3.0 mm, the voltage rating was 78 volts, or approximately half that of varistor 10 for an identical electrode spacing. Similarly, an electrode spacing of 4.5 mm in varistor 110 produced a measured voltage rating of approximately 80 volts. These measurements are set out below in the second line of Table A.

TABLE A

| | | Electrode Separation | | |
|---|---|---|---|---|
| | | 1.5 mm | 3.0 mm | 4.5 mm |
| Voltage Rating | Varistor 10 | 55 | 113 | 167 |
| | Varistor 110 | 56 | 78 | 80 |

As indicated in Table A, in the varistor 10 (i.e., in the absence of the conductive layer 124) the voltage increases proportionally with the surface spacing between the electrodes 18 and 20. In the varistor 110, with the conductive layer 124 present, the voltage between the electrodes 118 and 120 levels off at approximately 78–80 volts and becomes independent of the distance between the electrodes at electrode spacings of approximately twice the thickness of the varistor body 112. This "leveling off" voltage of 78–80 volts is approximately equal to twice the voltage which would be obtained by biasing either electrode 118 or electrode 120 against the conductive layer 124. This fact tends to indicate that, in the varistor 110, at electrode spacings of approximately two or more times the thickness T of the varistor body 112, the current path tends to flow through the varistor body rather than along the surface.

While the precise nature of the varistor characteristics of the varistor device 110 of FIG. 2 are not yet fully understood, it is theorized that the current flow through the device tends to follow a path of "least resistance". In other words, current will tend to flow from one conductor to the nearest adjacent conductor, regardless of whether that nearest adjacent conductor is on the same major surface or the opposing major surface of the varistor body. Therefore, when the thickness T of the varistor body 112 is smaller than the distance between the electrodes 118 and 120, current will tend to flow from the electrodes 118 and 120 to the relatively closer conductive layer 124, rather than flowing directly between the electrodes 118 and 120.

The voltage rating of such a device will therefore be determined along a generally U-shaped current path, from the first electrode 118 on the first major surface 114, through the thickness of the varistor body 112 to the opposed conductive material 124 on the second major surface 116, and then back again through the thickness of the varistor body 112 to the second electrode 120.

In traveling through the thickness of the varistor body from the first electrode 118 to the conductive layer 124, the current will undergo a first voltage drop $V_1$. The current will similarly undergo a second voltage drop $V_2$ in traveling through the thickness of the varistor body from the conductive layer 124 back to the second electrode 120. However, no substantial voltage drop will be experienced by the current while traveling along the conductive layer 124. Thus, if the distance between electrodes 118 and 120 is approximately equal to or greater than the sum of the distances between the electrode 118 and the conductive layer 124 and the electrode 120 and the conductive layer 124, the total voltage $V_t$ measured between electrodes 118 and 120 will be given by the following equation:

$$V_t = V_1 + V_2.$$

Moreover, since the voltage rating of the varistor device 110 depends predominately upon the passage of the current through the thickness T of the varistor body 112, the total voltage $V_t$ between electrodes 118 and 120 will not vary substantially as the separation between the electrodes 118 and 120 is varied (for electrode separations greater than T). This provides a theoretical explanation for the relative consistency of the voltage ratings set out in Table A above for electrode spacings greater than twice the thickness T of the varistor body 112.

Figure 3:
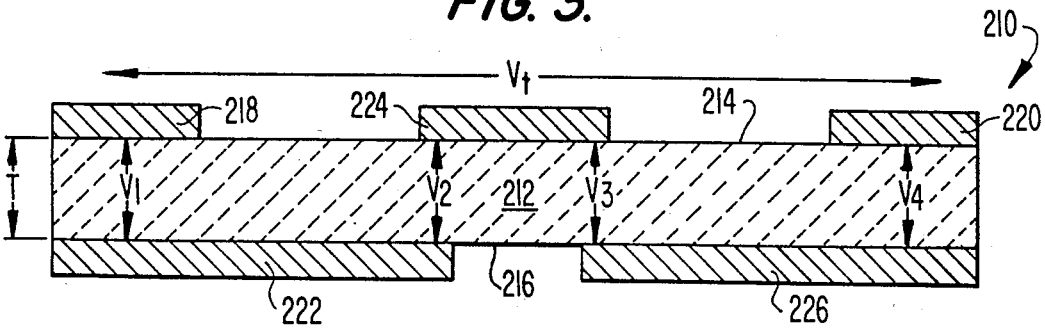
FIG. 3 is a side-sectional view of an alternative embodiment of the invention in which a plurality of layers of conductive material are positioned in alternating, overlapping fashion on opposed major surfaces of a varistor body.

FIG. 3 illustrates a varistor 210 in accordance with an alternative embodiment of the present invention. A varistor body 212 has first and second electrodes 218 and 220 attached to the first major surface 214 thereof. The formation of body 212, as well as the attachment of the electrodes 218 and 220 thereto may be as hereinabove described in conjunction with FIG. 1.

Varistor 210 further includes a conductive layer 224 which is applied to the first major surface 214 of the varistor body 212 at a location on the surface 214 between the electrodes 218 and 220. Varistor 210 also includes conductive layers 222 and 226 which are applied to the second major surface 216 of the varistor body 212. The conductive layers 222, 224, and 226 may advantageously be positioned in alternating, overlapping relationship as illustrated in FIG. 3, so that, when viewed from a plane which is parallel to the major surfaces 214 and 216, a portion of the conductive layer 224 appears to overlap a portion of both the conductive layers 222 and 226.

It is believed that the current flow through the device of FIG. 3, as with that of FIG. 2, will tend to follow a path of "least resistance" and will tend to flow to the nearest adjacent conductor. If the thickness T of the varistor body 212 is less than approximately one-half the separation between conductive layer 224 and electrodes 218 and 220, the current through such a device will tend to flow along the following path: (1) from the first electrode 218 through the thickness of the varistor body 212 to the opposed conductive layer 222, (2) from the conductive layer 222 through the thickness of the varistor body to the conductive layer 224, (3) from the conductive layer 224 through the thickness of the varistor body to the conductive layer 226, and (4) from the conductive layer 226 through the thickness of the varistor body to the electrode 220.

Again, as with the device 110 illustrated in FIG. 2, the current passing through the device 210 of FIG. 3 will experience a voltage drop during each passage of the current through the thickness T of the varistor body 212. These voltage drops may be identified as $V_1$, $V_2$, $V_3$ and $V_4$, corresponding respectively to the voltage drops experienced by the current in passing: (1) from electrode 218 to conductive layer 222, (2) from conductive layer 222 to conductive layer 224, (3) from conductive layer 224 to conductive layer 226, and (4) from conductive layer 226 to electrode 220.

No substantial voltage drop is experienced by the current as it travels along the conductive layers 222, 224, and 226. Thus, be given by the following equation:

$$V_t = V_1 + V_2 + V_3 + V_4.$$

It will be recognized, therefore, that the total voltage rating $V_t$ of a varistor device in accordance with the present invention may be increased to any of a number of different levels, without increasing the thickness T of the varistor body, merely by adding additional regions of conductive material to the opposed major surfaces of the varistor body, such that the distance separating any conductive region and the nearest adjacent conductive region on the same surface of the varistor body is greater than the distance separating that conductive region and the nearest conductive region on the opposed surface of the varistor body. In general, for a varistor in which the distance between same surface electrodes is approximately equal to or greater than twice the thickness of the varistor body, the total voltage rating $V_t$ of such a device is given by the following equation:

$$V_t = V_1/mm_1T_1 + V_2/mm_2T_2 + \ldots + V_n/mm_nT_n$$

where $T_n$ is the thickness or distance between the opposed conductive regions at the nth current crossing and $V_n/mm_n$ is the voltage gradient through the thickness of the varistor body at the nth current crossing.

Figure 4:
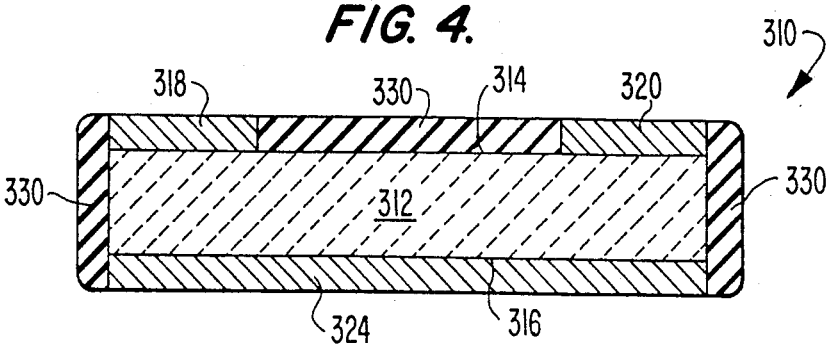
FIG. 4 is a side-sectional view of an alternative embodiment of the invention in which insulating material covers the nonconductive surface areas of the varistor body.

FIG. 4 illustrates a varistor 310 in accordance with an alternative embodiment of the present invention. A varistor body 312 has first and second electrodes 318 and 320 attached to the first major surface 314 thereof. The varistor 310 further includes a conductive layer 324 which is applied to the second major surface 316 of the varistor body 312. The relative positioning of the conductive layer 324 and electrodes 318 and 320 of the varistor 310 therefore closely resembles that of the varistor 110 illustrated in FIG. 2.

In the device 310 of FIG. 4, however, the areas between the conductive elements 318, 320 and 324 on the surface of the varistor body 312 are covered by an insulating or passivating material 330. This insulating material may, for example, be in the form of a glass or dielectric polymer. A passivating coating, such as that described in U.S. Pat. No. 3,857,174, may also be utilized for this purpose. The insulating or passivating material 330 prevents stray currents from interfering with the operation of the varistor 310 and further allows the varistor 310 to be utilized in a relatively "dirty" atmosphere. That is, the presence of the insulating or passivating material 330 allows the varistor 310 to be soldered without flux, and without mobile ions interfering with the active surface 314 of the varistor body 312 between the electrodes 318 and 320. The passivating or insulating material 330 thereby serves to improve device stability and reduce leakage current, thus providing substantially improved device performance.

Figure 5:
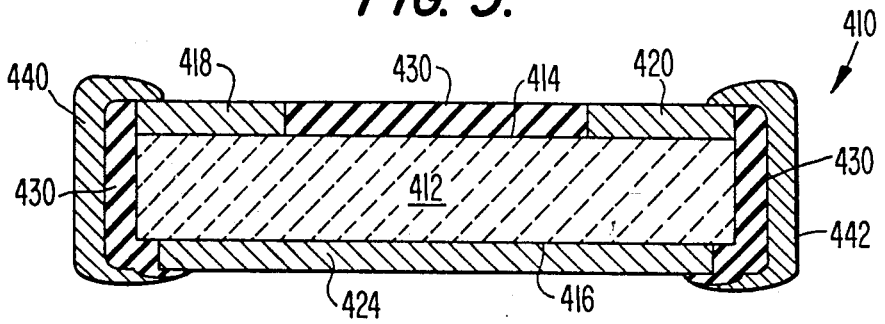
FIG. 5 is a side-sectional view of an alternative embodiment of the invention in which metalization is provided along the edges of the varistor.

FIG. 5 illustrates a varistor 410 in accordance with another alternative embodiment of the present invention. A varistor body 412 has first and second electrodes 418 and 420 attached to the first major surface 414 thereof, as well as a conductive layer 424 applied to the second major surface 416 of the varistor body 412 in a configuration which is similar to that of varistor 310 illustrated in FIG. 4. The surfaces of the varistor body 412 between the conductive elements 418, 420 and 424 are covered with an insulating or passivating material 430 in a manner similar to that of the device of FIG. 4. In the device 410 of FIG. 5, however, a layer of metalization 440, 442 is provide on each edge of the varistor 410. The metalization layers 440 and 442, which are preferably made of silver, are in electrical contact respectively with the electrodes 418 and 420 and extend along the edge of the varistor 410 from the electrodes to a region adjacent the second major surface 416. To prevent shorting, the metalization layers 440 and 442 are insulated from both the varistor body 412 and the conductive layer 424 by the insulative or passivating material 430.

The varistor 410 is particularly well-suited for those applications in which the varistor is to be placed upon a printed circuit board. In such applications the conductive surfaces of the electrodes are typically positioned directly above the conductive runners of the printed circuit board. A solder paste is positioned between each conductive electrode surface and the respective conductive runner, and the entire assembly is heated, thereby causing the solder to melt and producing an electrical contact between the electrodes and the conducting runners of the printed circuit board.

The quality of this soldered contact is largely determined by a visual inspection of the solder "fillet" after the heating process. The provision of metalization layers 440 and 442 along the edges of the varistor 410 facilitates the observation of the solder fillet. In the absence of the metalization layers 440 and 442, the solder fillet would be positioned substantially underneath the varistor body 412 and therefore be hidden from easy observation. It has also been found experimentally that provision of the metalization layers also improves the performance characteristics of the varistor device.

Figure 7:
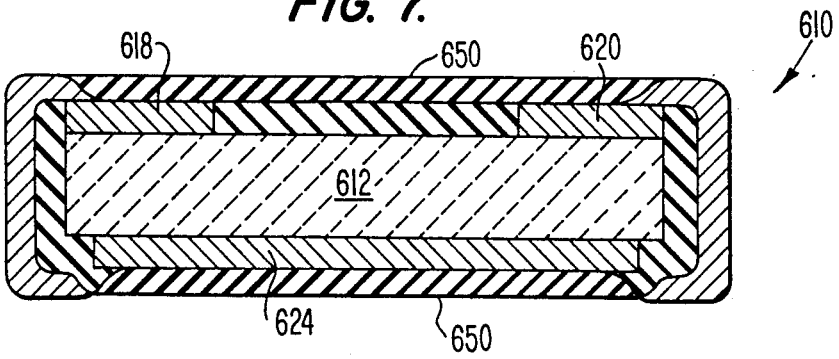
FIG. 7 is a side-sectional view of an alternative embodiment of the the present invention in which insulative material is disposed atop the conducting surfaces.

FIG. 7 illustrates a varistor 610 having first and second electrodes 618 and 620 and a conductive layer 624 disposed about the first and second major surfaces 614 and 616 of the varistor body 612 in a manner similar to that of varistor 410 of FIG. 5. In the varistor device 610 of FIG. 7, however, the surfaces of the conductive regions 618, 620 and 624 are coated with an insulating dielectric material 650. This insulating material 650 may, for example, be in the form of a glass or polymer.

Figure 6:
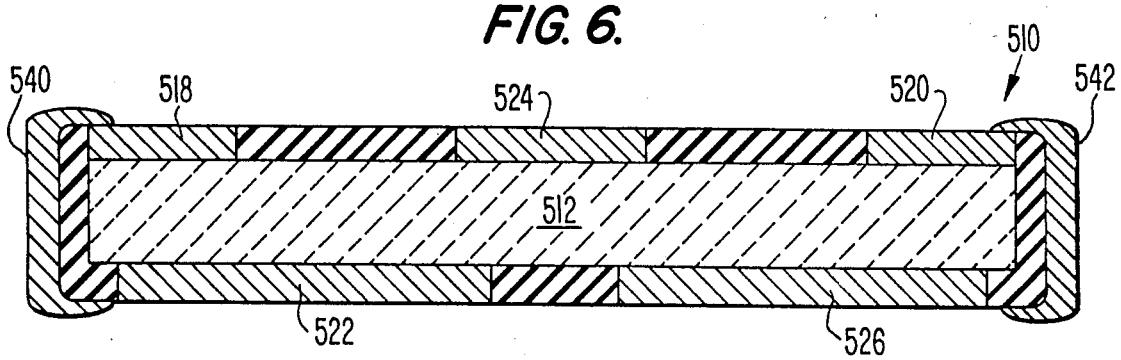
FIG. 6 is a side-sectional view of an alternative embodiment of the invention in which metalization is provided along the edges of a varistor having a plurality of layers of conductive material positioned in alternating, overlapping fashion on opposed major surfaces of the varistor body.

FIG. 6 illustrates a varistor 510 in accordance with still another embodiment of the present invention. A varistor body 512 has first and second electrodes 518 and 520 attached to the first major surface 514 thereof. The varistor 510 further includes conductive layers 522, 524, and 526 which are applied alternatively to the first and second major surfaces of the varistor body 512 in a configuration which resembles that of the device illustrated in FIG. 3. The varistor 510 also includes metalization layers 540 and 542 which are applied in a manner similar to those illustrated in FIG. 5, and which provide the same advantages as discussed above with respect to varistor 410 of FIG. 50.

Figure 8:
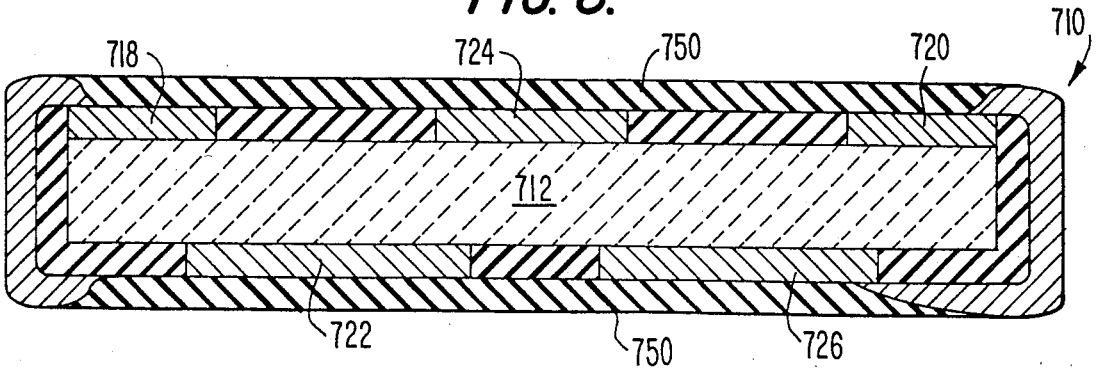
FIG. 8 is a side-sectional view of an alternative embodiment of the present invention in which insulative material is disposed atop the conducting surfaces.

FIG. 8 illustrates a varistor device 710 having first and second electrodes 718 and 720 and conductive regions 722, 724 and 726 disposed about the first and second major surfaces 714 and 716 of the varistor body 712 in a manner similar to that of varistor 510 illustrated in FIG. 6. In the varistor device 710 of FIG. 8, however, the surfaces of the electrodes 718 and 720 and the conductive regions 722, 724 and 726 are covered by an insulating dielectric material 750.

It will therefore be recognized that the present invention may be embodied in a variety of specific forms. The foregoing disclosed embodiments are therefore to be considered in all respects as illustrative and not restrictive. The scope of the invention being indicated by the appended claims, rather than the foregoing description, and all variations which come within the meaning and range of equivalency of the claims are intended to be embraced therein.

What is claimed is:

1. A varistor comprising:

a varistor body having a first major surface and an opposed second major surface;

a plurality of conductive regions disposed in spaced relationship on said first surface;

a plurality of conductive regions disposed in spaced relationship on said second surface;

said conductive regions being positioned such that the distance separating any conductive region and the nearest adjacent conductive region on the same surface of the varistor body is greater than the distance separating that conductive region and the nearest conductive region on the opposed surface of the varistor body, wherein current will tend to flow from any of said conductive regions through the thickness of said varistor body to one of said conductive regions on the opposed surface of said varistor body.

2. A varistor comprising:

a varistor body having opposed major surfaces;

a plurality of spaced conductive regions formed on each of said opposed major surfaces;

each of said conductive regions being positioned such that at least one conductive region on the opposed major surface of the varistor body is nearer to said conductive region than any conductive region on the same surface whereby current will tend to flow from one of said conductive regions through the thickness of said varistor body to the nearest one of said conductive regions on said supposed major surface.

3. A varistor according to claim 2 wherein an insulating material covers the nonconductive surface areas of said varistor.

4. A varistor according to claim 2 wherein the edges of the varistor have a metal coating.

5. A varistor according to claim 4 wherein said conductive material is positioned in alternating overlapping fashion on said opposed major surfaces.

6. A varistor according to claim 2 wherein an insulating material is disposed over said conductive surfaces.

7. A varistor according to claim 4 wherein an insulating material is disposed over said conductive surfaces.

8. A varistor body having opposed major surfaces;

at least two electrodes on a first major surface to each of which is attached a lead, at least one layer of non-biased conductive material on a second major surface wherein the distance between the electrodes on said first major surface is greater than the distance between an electrode on said first surface and the conductive layer on said second surface whereby the voltage rating of said varistor becomes independent of the electrode spacing on said first surface above an electrode spacing about at least two times the thickness of said varistor body.

* * * * *